US010052626B2

(12) United States Patent
Herbst et al.

(10) Patent No.: US 10,052,626 B2
(45) Date of Patent: Aug. 21, 2018

(54) PIPETTE TIP

(71) Applicant: Corning Incorporated, Corning, NY (US)

(72) Inventors: Royce Charles Herbst, Alpine, UT (US); West Lavar Price, Draper, UT (US); Fredrick Carling Steed, Sandy, UT (US)

(73) Assignee: Corning Incorporated, Corning, NY (US)

( * ) Notice: Subject to any disclaimer, the term of this patent is extended or adjusted under 35 U.S.C. 154(b) by 162 days.

(21) Appl. No.: 14/888,188

(22) PCT Filed: Apr. 29, 2014

(86) PCT No.: PCT/US2014/035781
§ 371 (c)(1),
(2) Date: Oct. 30, 2015

(87) PCT Pub. No.: WO2014/179256
PCT Pub. Date: Nov. 6, 2014

(65) Prior Publication Data

US 2016/0051979 A1 Feb. 25, 2016

Related U.S. Application Data

(60) Provisional application No. 61/817,551, filed on Apr. 30, 2013.

(51) Int. Cl.
*B01L 3/02* (2006.01)

(52) U.S. Cl.
CPC ..... *B01L 3/0275* (2013.01); *B01L 3/0279* (2013.01); *B01L 2200/0689* (2013.01); *B01L 2200/12* (2013.01); *B01L 2300/0832* (2013.01); *B01L 2300/0858* (2013.01)

(58) Field of Classification Search
None
See application file for complete search history.

(56) References Cited

U.S. PATENT DOCUMENTS

| | | | |
|---|---|---|---|
| 6,168,761 | B1 | 1/2001 | Kelly et al. |
| 6,171,553 | B1 | 1/2001 | Petrek |
| 6,568,288 | B2 | 5/2003 | Rainin et al. |
| 6,737,023 | B1 | 5/2004 | Kelly et al. |
| 6,745,636 | B2 | 6/2004 | Rainin et al. |
| 6,955,077 | B2 | 10/2005 | Blaszcak et al. |

(Continued)

FOREIGN PATENT DOCUMENTS

| | | | |
|---|---|---|---|
| JP | 03748231 | B2 | 2/2006 |

*Primary Examiner* — Paul West
*Assistant Examiner* — Mark A Shabman
(74) *Attorney, Agent, or Firm* — John P. Ciccarelli

(57) ABSTRACT

A pipette tip (10) including: a proximal end (11) and a proximal body region (12) defining a first cavity that receives a flatted pipette member; and a distal end (13) and a distal body region (14) defining a second cavity that receives and discharges a liquid aspirated by the pipette member; the cavities are in gas-liquid communication, the first cavity is defined by various resilient surfaces as defined herein, one cylindrical surface (25) forms a gas-liquid seal with the pipette member, and which surfaces are free of, for example, an internal stop structure, a distinct sealing structure, or both. Methods of making and using the article are also disclosed.

18 Claims, 2 Drawing Sheets

(56) References Cited

U.S. PATENT DOCUMENTS

| | | | | |
|---|---|---|---|---|
| 6,967,044 | B1 | 11/2005 | O'Brien | |
| 7,047,828 | B2 | 5/2006 | Blaszcak et al. | |
| 8,343,438 | B1 | 1/2013 | Smith | |
| 2003/0200821 | A1 | 10/2003 | Rainin et al. | |
| 2005/0175511 | A1 | 8/2005 | Cote et al. | |
| 2005/0255005 | A1* | 11/2005 | Motadel | B01L 3/0275 422/400 |
| 2007/0297948 | A1 | 12/2007 | May et al. | |
| 2008/0078258 | A1* | 4/2008 | Price | B01L 3/0279 73/864.01 |
| 2013/0059027 | A1* | 3/2013 | Schottli | B29C 45/36 425/577 |

* cited by examiner

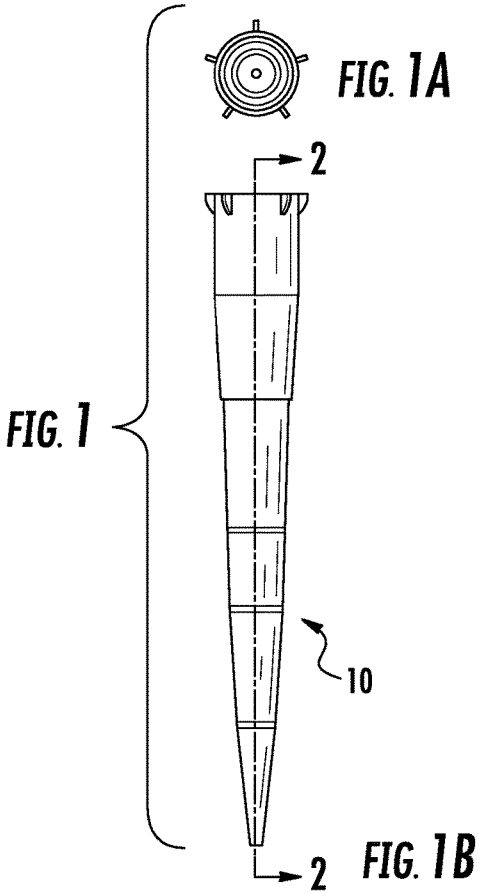
FIG. 1A
2
FIG. 1
10
2
FIG. 1B
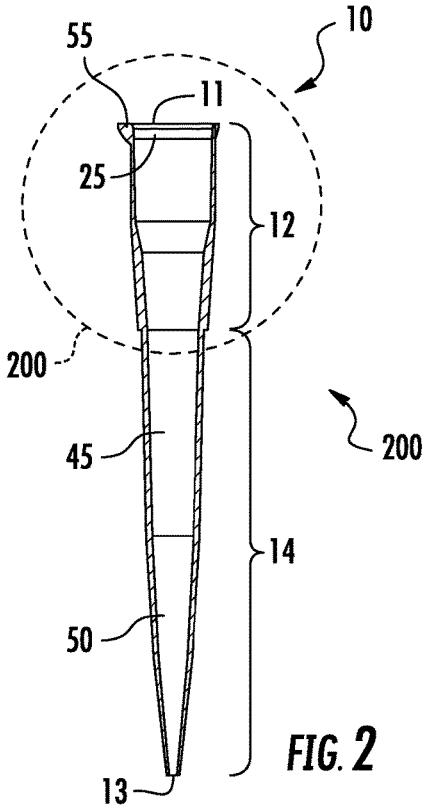
55
10
11
25
12
200
200
45
14
50
13
FIG. 2
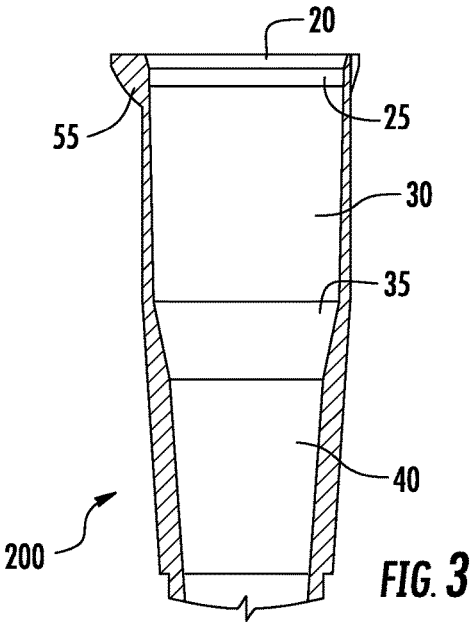
20
55
25
30
35
40
200
FIG. 3

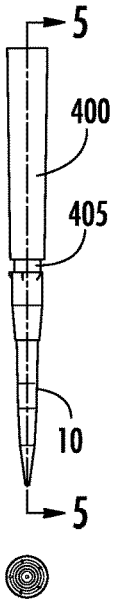
FIG. 4
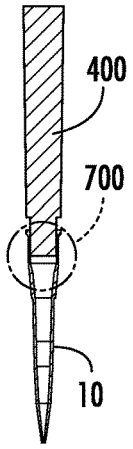
FIG. 5
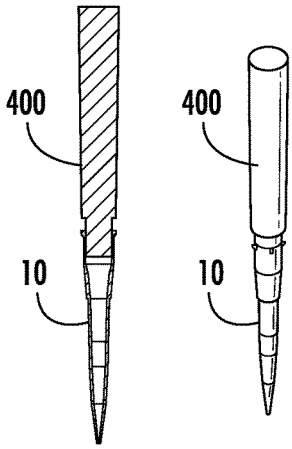
FIG. 6A FIG. 6b
FIG. 6
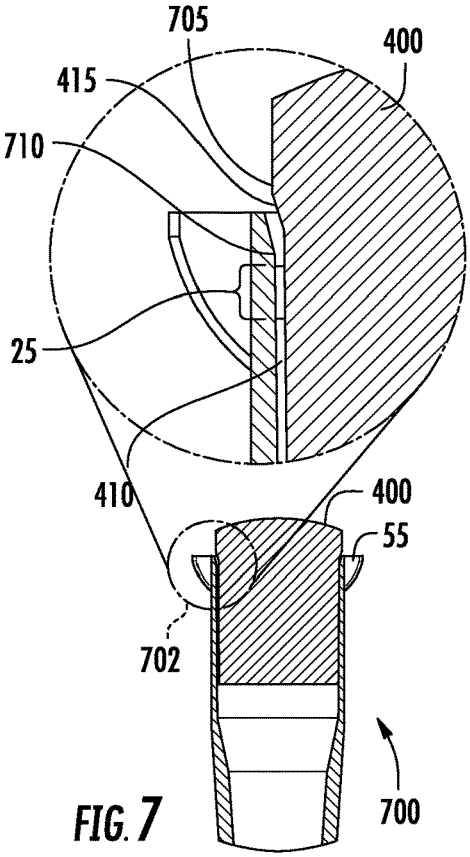
FIG. 7
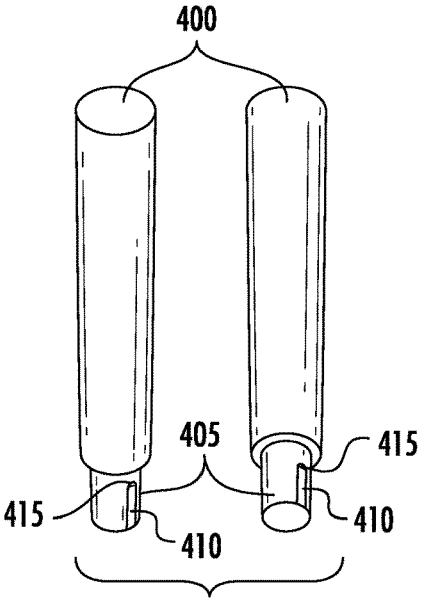
FIG. 8
(PRIOR ART)

PIPETTE TIP

This application claims the benefit of priority to U.S. Application No. 61/817,551 filed on Apr. 30, 2013 the content of which is incorporated herein by reference in its entirety.

The entire disclosure of any publication or patent document mentioned herein is incorporated by reference.

BACKGROUND

The disclosure generally relates to a pipette tip article and methods of making and using the article.

SUMMARY

The disclosure provides a pipette tip article for use in transferring and dispensing liquids. The disclosed pipette tip structure has an interior chamber for receiving and dispensing liquids, and for engaging with and forming an air-liquid seal with a pipettor shaft (instrument). The interior chamber or cavity is relatively smooth and flexible, and is free of one or more distinct or discrete internal "stop" structures, "sealing" structures, or both. Accordingly, the disclosed pipette tip article provides for relatively low separation force (aka. "soft eject") of the combined pipette tip and pipettor, and a low cost, high seal reliability "stop-less" design. The pipette tip structure can also include exterior fins, or like structures, for separation or disengagement (ejectment) of the sealed pipette tip from a tip and pipettor shaft combination. The exterior of the pipette tip is free of reinforcing rib structures.

In embodiments, the disclosure provides methods for making the disclosed article, and methods of using the disclosed article in transferring and dispensing liquids.

BRIEF DESCRIPTION OF THE DRAWINGS

In embodiments of the disclosure:

FIGS. 1A and 1B respectively show an end or axial view (1A), and a side elevation view of an exemplary pipette tip article (10) (1B).

FIG. 2 shows the cross section view A-A of the pipette tip article (10) of FIG. 1B.

FIG. 3 shows a detailed view of area (200) of the pipette tip article of FIG. 2.

FIG. 4 shows a side elevation view of the combination of the pipette tip article (10) of FIG. 1B and a pipettor shaft (400).

FIG. 5 shows the cross section view A-A of the partial combination or unsealed combination of the pipette tip article (10) and the pipettor shaft (400) of FIG. 4.

FIGS. 6A and 6B respectively show the cross section view B-B of the completed combination or sealed combination of the pipette tip article (10) and the pipettor shaft (400) (FIG. 6A) of FIG. 4, and a perspective view of the completed combination or sealed combination of the pipette tip article (10) and the pipettor shaft (400) of FIG. 6A (FIG. 6B).

FIG. 7 shows a detailed view of area (700) of the cross section view B-B of the partial combination or unsealed combination of the pipette tip article and the pipettor shaft (400) of FIG. 5, and a detailed view of the unsealed sealing region (702) illustrating the sealing area (25) of FIG. 3 in the presence of the pipettor shaft (400).

FIG. 8 shows two different perspective views of the PRIOR ART pipettor shaft (400) having the shaft-to-tip contact region (405), the shaft flat region (410), and the shaft-to-tip sealing region (415).

DETAILED DESCRIPTION

Various embodiments of the disclosure will be described in detail with reference to drawings, if any. Reference to various embodiments does not limit the scope of the invention, which is limited only by the scope of the claims attached hereto. Additionally, any examples set forth in this specification are not limiting and merely set forth some of the many possible embodiments of the claimed invention.

In embodiments, the disclosed article and the disclosed method of making and using the article provide one or more advantageous features or aspects, including for example as discussed below. Features or aspects recited in any of the claims are generally applicable to all facets of the invention. Any recited single or multiple feature or aspect in any one claim can be combined or permuted with any other recited feature or aspect in any other claim or claims.

Definitions

"Include," "includes," or like terms means encompassing but not limited to, that is, inclusive and not exclusive.

"About" modifying, for example, the quantity of an ingredient in a composition, concentrations, volumes, process temperature, process time, yields, flow rates, pressures, viscosities, and like values, and ranges thereof, or a dimension of a component, and like values, and ranges thereof, employed in describing the embodiments of the disclosure, refers to variation in the numerical quantity that can occur, for example: through typical measuring and handling procedures used for preparing materials, compositions, composites, concentrates, component parts, articles of manufacture, or use formulations; through inadvertent error in these procedures; through differences in the manufacture, source, or purity of starting materials or ingredients used to carry out the methods; and like considerations. The term "about" also encompasses amounts that differ due to aging of a composition or formulation with a particular initial concentration or mixture, and amounts that differ due to mixing or processing a composition or formulation with a particular initial concentration or mixture. The claims appended hereto include equivalents of these "about" quantities.

"Optional" or "optionally" means that the subsequently described event or circumstance can or cannot occur, and that the description includes instances where the event or circumstance occurs and instances where it does not.

The indefinite article "a" or "an" and its corresponding definite article "the" as used herein means at least one, or one or more, unless specified otherwise.

Abbreviations, which are well known to one of ordinary skill in the art, may be used (e.g., "h" or "hrs" for hour or hours, "g" or "gm" for gram(s), "mL" for milliliters, and "rt" for room temperature, "nm" for nanometers, and like abbreviations).

Specific and preferred values disclosed for components, ingredients, additives, dimensions, conditions, and like aspects, and ranges thereof, are for illustration only; they do not exclude other defined values or other values within defined ranges. The apparatus and methods of the disclosure can include any value or any combination of the values, specific values, more specific values, and preferred values described herein, including explicit or implicit intermediate values and ranges.

U.S. Pat. Nos. 6,168,761; 6,171,553; 6,568,288; 6,737,023; 6,745,636; and 6,967,004, to Rainin, U.S. Pat. Nos. 7,047,828, and 6,955,077, to Quality Scientific Plastics, and JP 03748231 B2, mention pipette tips having, for example, distinct internal structures such as a penetration stop, a seal member, stabilizing projection, a recess or negative relief, and like features, or a combination thereof. In contrast, the presently disclosed pipette article does not include one or more of the following prior art pipette tip features: a flexible internal or inside branch wall for forming a fluid-tight seal with a pipette instrument; one or more internal stabilizing projections (as illustrated in for example U.S. Pat. No. 7,047,828, FIGS. 7 and 8, (24) and (80), and U.S. Pat. No. 6,955,077, FIG. 5), or a recess or negative relief feature (as illustrated in for example JP 03748231 B2, recess 322).

The disclosed pipette tip article can be categorized a "soft eject" tip, a "stop-less" tip, or both, design. The disclosed pipette tip article has a relatively smooth and flexible internal cavity that is free of one or more of the above mentioned distinct internal "stop" or "sealing" structures, and optionally the exterior body of the pipette tip is free of reinforcing rib structures.

The disclosed pipette tip article is particularly advantaged by not having or including one or more of the following structural features: an internal stop structure, for example, to prevent further or excess penetration of the pipette shaft into the pipette tip; an internal sealing structure, such as a protuberance, a rib, a lip, a branch or secondary flexible wall, etc.; a thick or rigid body wall structure; or an external rib structure for structural reinforcement of the body. The absence of these features can significantly simplify tooling and manufacture, reduce the cost of tip manufacture, enhance the ease of tip separation, and maintain high tip ejectment reliability through many use cycles.

Referring to the Figures, FIGS. 1A and 1B respectively show an end or axial view (1A), and an side elevation view of an exemplary pipette tip article (10) (1B).

FIG. 2 shows the cross section view A-A of the pipette tip article (10) of FIG. 1B having a proximal end (11) having an aperture and a proximal body region (12) (i.e., a "head" or "collar") and having a first internal cavity that receives a pipette member (aka: pipette mandrel); and a distal end (13) having an aperture and a distal body region (14) (i.e., "a liquid tip") having a second internal cavity that in operation receives and discharges a liquid aspirated by the pipette member. The proximal body region (12) is encompassed by detail (200) as magnified in FIG. 3. The proximal first internal cavity can include, for example, a first conic surface (20) at the proximal end; a first cylindrical surface (25) (i.e., having no draft or taper) adjacent the first conic surface; a second conic surface (30) adjacent the first cylindrical surface; a third conic surface (35) adjacent the second conic surface; a fourth conic surface (40) adjacent the third conic surface. The distal second internal cavity can include, for example: a fifth conic surface (45) adjacent the fourth conic surface of the proximal body region; and a sixth conic surface (50) at the distal end aperture and adjacent the fifth conic surface; and optionally a plurality of radial fins (55), such as from about 2 to about 10 fins.

FIG. 3 shows the detailed view of area (200) of the pipette tip article of FIG. 2, showing conics and cylinders of proximal region (12) specifically calling out the aforementioned surfaces (20), (25), (30), (35), (40), (45), and (50), and fins (55).

FIG. 4 shows a side elevation view of the combination of the pipette tip article (10) of FIG. 1B and a pipettor shaft (400) having shaft contact region (405).

FIG. 5 shows the cross section view A-A of the partial combination or unsealed combination of the pipette tip article (10) and the pipettor shaft (400) of FIG. 4 in detail area (700) discussed below and shown in FIG. 7.

FIGS. 6A and 6B respectively show the cross section view B-B of the completed combination or sealed combination of the pipette tip article (10) and the pipettor shaft (400) (see FIG. 6A) of FIG. 4, and a perspective view of the completed combination or sealed combination of the pipette tip article (10) and the pipettor shaft (400) of FIG. 6A (see FIG. 6B).

FIG. 7 shows a view of detailed area (700) of the cross section view B-B of the partial combination or unsealed combination of the pipette tip article (10) and the pipettor shaft (400) of FIG. 5 and fins (55), and a further detailed view of sealing region (702) illustrating the seal area (25) of FIG. 3 in the presence of the pipettor shaft (400). The shaft flat (410) permits insertion of the shaft-to-tip sealing region (405) of the shaft (400) into the head or sealing region (25) of the pipette tip (10). The seal between the pipette tip article (10) and the pipettor shaft (400) is completed when, for example, under gentle mechanical or robotic urging of the tip, the shaft, or both, the point (705) of the pipettor shaft (400) and the shaft-to-tip sealing region (415) meets point (710) of the pipettor tip (10).

FIG. 8 shows two different perspective views of the PRIOR ART pipettor shaft (400) having the shaft-to-tip contact region (405), the shaft flat region (410), and the shaft-to-tip sealing region (415). The tip and shaft combination forms a complete seal when the seal area (25) of the tip advances to the shaft's shaft-to-tip sealing region (415). Alternatively or additionally, the tip-shaft seal is completed when the penetration of the shaft-to-tip sealing region (415) is within or beneath the tip's seal area (25). The plurality of fins (55) on the wide opening top or proximal portion or part of the tip provide a contact area where, after use, an ejector bar on the pipettor can be deployed to engage a portion of the tip and readily eject the tip from the shaft.

In embodiments, the present disclosure provides a pipette tip article comprising:

a proximal end and a proximal body region defining a first cavity that receives a flatted portion of a pipette shaft; and a distal end and a distal body region defining a second cavity that receives and discharges a liquid aspirated by the pipette member;

the first and second cavities are in gas-liquid communication, and the first cavity is defined by various (i.e., a plurality of) resilient surfaces including a particular cylindrical surface (25) that forms a gas-liquid seal with the pipette member when the pipette shaft penetrates the pipette tip beyond flat or flattened portion of the pipette shaft, and which resilient surfaces are free of an internal stop structure, a distinct sealing structure, or both.

In embodiments, the present disclosure provides a pipette tip article comprising:

a proximal end (11) having an aperture and a proximal body region (12) (i.e., a "head" or "collar") having a first internal cavity that receives a pipette member (aka: pipette mandrel); and a distal end (13) having an aperture and a distal body region (14) (i.e., "a liquid tip") having a second internal cavity that in operation receives and discharges a liquid aspirated by the pipette member;

the proximal body region is juxtaposed to (i.e., "abuts") the distal body region, and the respective proximal first and distal second internal cavities are in gas-liquid communication, the proximal first internal cavity includes in order of occurrence:

a first conic surface (20) at the proximal end;

a first cylindrical surface (25) (i.e., having no draft or taper) adjacent the first conic surface;

a second conic surface (30) adjacent the first cylindrical surface;

a third conic surface (35) adjacent the second conic surface;

a fourth conic surface (40) adjacent the third conic surface;

wherein:

the first conic surface (ca., 30°, such as from about 25 to 35°) has a substantially greater relative taper than the second conic surface (ca., 2.6°), the second conic surface (ca., 2.6°, such as from about 2.2 to 3.0°) has a substantially lesser relative taper than the third conic surface (ca., 22.74°), and the third conic surface (ca., 22.74°, such as from about 20 to 25°) has a substantially greater relative taper than the fourth conic surface (ca., 9.28°);

the distal second internal cavity includes:

a fifth conic surface (45) adjacent the fourth conic surface of the proximal body region; and a sixth conic surface (50) at the distal end aperture and adjacent the fifth conic surface; and optionally a plurality of radial fins (55), or like structures such as an exterior lip or ring, integrally attached at the proximal end and on a portion of the exterior surface of the proximal body region near the proximal end.

In embodiments, one or more of the abovementioned conic surfaces can be modified, such as to have more or less taper than described, or omitted from the tip structure entirely, so long as the operational structure and functional characteristics of the pipette tip are preserved.

In embodiments, the disclosed dimensions and scales are exemplary and are not limiting. Alternative dimensions and scales are readily evident and readily achieved by modifications that are relatively apparent to those skilled in the art.

In embodiments, the pipette tip can be, for example, an injection molded monolith of a single polymer, such as polypropylene, or a blend of polymers, such as a mixture of different grades or molecular weights of a polypropylene, i.e., a single resin or mixed resin, and not separated or distinct polymers for different portions or components of the tip structure.

In embodiments, the pipette tip can be, for example, disposable such as for sterile, clean, one-time, or single use, or recyclable, reusable, or repurposed, or like uses or practices.

In embodiments, the pipette tip's first cylindrical surface (25) (i.e., having no draft or taper) adjacent the first conic surface (20) provides a gas-liquid seal when the pipette shaft member is sufficiently inserted into the proximate first internal cavity region of the pipette tip.

In embodiments, the pipette tip's gas-liquid seal is completed when the flattened shaft portion (410) of the pipette member penetrates the first cylindrical surface of the pipette tip, i.e., a "flat" used as a noun; having a flat portion on the exterior of the shaft of the pipette member.

In embodiments, the pipette tip's first internal cavity is free of a "stop" structure (i.e., "stop-less"), i.e., a "stop" or fixed structure such as a ring, a band, a rim, a ridge, a protuberance, a protrusion, a seat, a shelf, a pimple, a bump, etc., that prevents further penetration of the pipette into the proximal first internal cavity region of the tip.

In embodiments, the pipette tip's first internal cavity is free of an additional distinct movable sealing structure, e.g., a secondary inner flexible wall, a baffle, a tab, a branch, or like displaceable, deformable, or deflectable member, etc., that forms a liquid-gas seal between the inserted pipette shaft member and the pipette tip.

In embodiments, the pipette tip's optional plurality of radial fins (55) provide a contact surface for engaging the pipette's ejector (e.g., a release bar member), and the fins can optionally provide, if desired, an external stop against the pipette ejector or pipette shaft.

In embodiments, the pipette tip's wall thickness of the proximal body region increases from the proximal end to the proximal body region adjacent the distal body region, and the wall thickness decreases from the distal body region adjacent the proximal body region traversing toward the distal end.

In embodiments, the wall thickness of the pipette tip at the proximal end, that is at the first conic surface (20), can be, for example, relatively thin, such as from about 0.004 to about 0.006 inches, for example, about 0.005 inches.

In embodiments, the wall thickness of the pipette tip at the first cylindrical surface (25) adjacent the first conic surface, can be, for example, slightly thicker than the first conic surface, such as from about 0.006 to about 0.008 inches, for example, about 0.007 inches.

In embodiments, the wall thickness of the pipette tip at the fourth conic surface (40) adjacent the third conic surface of the proximal body region, can be, for example, thicker than the wall thickness at the first cylindrical surface (25), and can be, for example, from about 0.020 to about 0.040 inches, for example, about 0.030 inches.

In embodiments, the wall thickness of the pipette tip at the fifth conic surface (45) adjacent the fourth conic surface, can be, for example, thinner than the wall thickness at the fourth conic surface (25), and can be, for example, from about 0.010 to about 0.030 inches, for example, about 0.020 inches.

In embodiments, the wall thickness of the pipette tip at the sixth conic surface (50) at the distal end aperture and adjacent the fifth conic surface (45), can be, for example, thinner than the wall thickness at the fifth conic surface (45), such as from about 0.006 about 0.008 inches, for example, about 0.007 inches.

In embodiments, the wall thickness at a depth of about 0.410 inches from the proximal end can be, for example, from about 0.02 to about 0.04 inches, and the wall thickness at a depth of about 0.650 inches from the proximal end can be, for example, from about 0.01 to about 0.03 inches.

In embodiments, the proximal region can be, for example, free of an external rib member(s), i.e., the absence of external rib member structures reduces stiffness or alternatively imparts greater flexibility or resiliency to the proximal region for receiving the pipette member and can facilitate formation of the gas-liquid seal.

In embodiments, the gas-liquid seal can be completed, for example, when the cylindrical portion above the flattened shaft portion of the pipette member contacts the proximal portion of the first cylindrical surface of the pipette tip.

In embodiments, a pipette shaft member suitable for engaging and sealing with the disclosed pipette tip has a conic section having about 1.2 degrees of arc or taper on each side of the conic or about 2.4 degrees of total taper of the conic with respect to a central vertical axis.

In embodiments, the present disclosure provides method of making the above mentioned pipette tip article, comprising:

injecting a plastic into the thick wall area of a mold cavity near the center of the mold.

The present pipette tip mold is preferably gated further down the proximal region of the tip mold, such as near the juxtaposition with the distal body region. In contrast, standard or conventional tip molds are typically gated at or near the proximal end.

In embodiments, the present disclosure provides method of using the abovementioned molded article comprising:

combining the pipette tip article and the shaft of a pipettor to form a liquid-air seal between the pipette tip article and the pipettor shaft;

receiving a liquid into the tip of the pipette tip and thereafter dispensing the liquid out of the pipette tip; and ejecting the pipette tip from the combined pipette tip and shaft of a pipettor, wherein the combining (i.e., mounting) and the ejecting are accomplished with the same, i.e., approximately equivalent, pressure or force, or a comparable on-off pressure or force.

The eject pressure used for the abovementioned molded article was relative to the amount of pressure used to mount the tip. If greater pressure is used to mount the tip then a proportionately greater pressure is needed to eject the tip from the pipette shaft. In contrast, preliminary comparative experiments showed that the mount pressure used for commercially available Rainin LTS tips did not appear to affect the eject pressure. If the presently disclosed tips are mounted very lightly then the tip will eject with a pressure that is comparable to the aforementioned commercially available Rainin LTS tips.

"Consisting essentially of" or "consisting of" in embodiments can refer to, for example:

a pipette tip article as substantially described herein having a single cylindrical sealing surface, and the tip article is free of: an internal additive or subtractive stop structure; an internal additive or subtractive seal structure; an external rib structure; or combinations thereof.

a method of making the pipette tip article as substantially described herein having plastic injected in one or more injection ports at or near the middle of the mold, that is near the thicker or thickest wall portions of the pipette tip, or alternatively and unexpectedly, at the end or ends of the mold form, that is near the thinner or thinnest wall portions of the pipette tip.

The article, the method of making the article, and the method of using the article, of the disclosure can include the components or steps listed in the claim, plus other components or steps that do not materially affect the basic and novel properties of the compositions, articles, apparatus, or methods of making and use of the disclosure, such as a particular article configuration, particular additives or ingredients, a particular agent, a particular structural material or component, a particular irradiation, pressure, or temperature condition, or like structure, material, or process variable selected.

EXAMPLES

The following examples serve to more fully describe the manner of using the above-described disclosure, and to further set forth best modes contemplated for carrying out various aspects of the disclosure. These examples do not limit the scope of this disclosure, but rather are presented for illustrative purposes. The working example(s) further describe(s) how to prepare the disclosed pipette tip articles.

Injection Mold Methods

In embodiments, one method of making the disclosed pipette tip includes, for example, conventional single shot injection molding equipment and methods with the exception that the point or points of the plastic injection is at or near the middle of the mold form rather than at or near the one or both ends of the mold form. Accordingly, the mold form can be designed and constructed having injection ports or gates near the middle of the mold form using conventional mold making and tooling methods.

In embodiments, another method of making the disclosed pipette tip can be, for example, injection molded using conventional single injection molding equipment and methods at the base or one or both ends of the mold see for example, U.S. Pat. No. 8,343,438.

In embodiments, the method of making can include injection molding the disclosed pipette tip article form having, for example, the same overall dimensions but having different proportions, different dimensions, or a larger or smaller relative scale than the disclosed particulars.

The disclosure has been described with reference to various specific embodiments and techniques. However, it should be understood that many variations and modifications are possible while remaining within the scope of the disclosure.

What is claimed is:

1. A pipette tip comprising:

a proximal end having an aperture and a proximal body region having a first internal cavity that receives a pipette member; and a distal end having an aperture and a distal body region having a second internal cavity that in operation receives and discharges a liquid aspirated by the pipette member;

the proximal body region is juxtaposed to the distal body region, and the respective proximal first and distal second internal cavities are in gas-liquid communication, the proximal first internal cavity includes in order of occurrence:

a first conic surface at the proximal end;

a first cylindrical surface adjacent the first conic surface;

a second conic surface adjacent the first cylindrical surface;

a third conic surface adjacent the second conic surface;

a fourth conic surface adjacent the third conic surface;

wherein:

the first conic surface has a greater taper than the second conic surface, the second conic surface has a lesser taper than the third conic surface, the third conic surface has a greater taper than the fourth conic surface, and the volume of the proximal first internal cavity defined by the second conic surface is greater than the volume of the proximal first internal cavity defined by the first cylindrical surface;

the distal second internal cavity includes:

a fifth conic surface adjacent the fourth conic surface of the proximal body region; and a sixth conic surface at the distal end aperture and adjacent the fifth conic surface; and a plurality of radial fins integrally attached at the proximal end and on a portion of the exterior surface of the proximal body region near the proximal end, wherein the tip is an injection molded monolith of a single polymer or a blend of polymers.

2. The pipette tip of claim 1 wherein the first cylindrical surface adjacent the first conic surface provides a gas-liquid seal when the pipette member is inserted into the proximate first internal cavity region of the pipette tip.

3. The pipette tip of claim 2 wherein the gas-liquid seal is completed when a flattened shaft portion of the pipette member penetrates the first cylindrical surface of the pipette tip.

4. The pipette tip of claim 3 wherein the gas-liquid seal is completed when the cylindrical portion above the flattened shaft portion of the pipette member contacts the proximal portion of the first cylindrical surface of the pipette tip.

5. The pipette tip of claim 1 wherein the first internal cavity is free of a stop structure that prevents further penetration of the pipette into the proximal first internal cavity region.

6. The pipette tip of claim 1 wherein the first internal cavity is free of a movable sealing structure that forms a liquid-gas seal between the inserted pipette member and the pipette tip.

7. The pipette tip of claim 1 wherein the plurality of radial fins provide a contact surface for engaging the pipette's release bar member, and the fins optionally provide an external stop against the pipette member.

8. The pipette tip of claim 1 wherein the wall thickness of the proximal body region increases from the proximal end to the proximal body region adjacent the distal body region, and the wall thickness decreases from the distal body region adjacent the proximal body region moving toward the distal end.

9. The pipette tip of claim 1 wherein the wall thickness of the pipette tip at the proximal end at the first conic surface is from about 0.004 to about 0.006 inches.

10. The pipette tip of claim 1 wherein the wall thickness of the pipette tip at the first cylindrical surface adjacent the first conic surface, is from about 0.006 to about 0.008 inches.

11. The pipette tip of claim 1 wherein the wall thickness of the pipette tip at the fourth conic surface adjacent the third conic surface of the proximal body region is from about 0.020 to about 0.040 inches.

12. The pipette tip of claim 1 wherein the wall thickness of the pipette tip at the fifth conic surface adjacent the fourth conic surface, is from about 0.010 to about 0.030 inches.

13. The pipette tip of claim 1 wherein the wall thickness of the pipette tip at the sixth conic surface at the distal end aperture and adjacent the fifth conic surface, is from about 0.006 to about 0.008 inches.

14. The pipette tip of claim 1 wherein the wall thickness at a depth of about 0.410 inches from the proximal end is from about 0.02 to about 0.04 inches, and the wall thickness at a depth of about 0.650 inches from the proximal end is from about 0.01 to about 0.03 inches.

15. A method of making the pipette tip article of claim 1 comprising:

injecting a plastic into the thick wall area of a mold cavity near the center of the mold.

16. The method of claim 15 wherein the injected plastic is polypropylene.

17. A method of using the article of claim 1 comprising:

combining the pipette tip article and the shaft of a pipettor to form a liquid-air seal between the pipette tip article and the shaft;

receiving a liquid into the tip of the pipette tip and thereafter dispensing the liquid out of the pipette tip; and ejecting the pipette tip from the combined pipette tip and shaft of a pipettor, wherein the combining and the ejecting are accomplished with a comparable on-off pressure.

18. A method of making the pipette tip article of claim 1 comprising:

injecting a plastic into the thin wall area of a mold cavity near the end or ends of the mold.

* * * * *